US010273745B2

(12) United States Patent
Wong

(10) Patent No.: US 10,273,745 B2
(45) Date of Patent: Apr. 30, 2019

(54) INSULATED FIRE PANEL SHUTTER

(71) Applicant: GLIDEROL DOORS (S) PTE. LTD., Singapore (SG)

(72) Inventor: Lok Yung Wong, Singapore (SG)

(73) Assignee: Gliderol Doors (s) PTE., LTD., Singapore (SG)

( * ) Notice: Subject to any disclaimer, the term of this patent is extended or adjusted under 35 U.S.C. 154(b) by 129 days.

(21) Appl. No.: 15/322,240

(22) PCT Filed: Jun. 26, 2015

(86) PCT No.: PCT/SG2015/000132
§ 371 (c)(1),
(2) Date: Dec. 27, 2016

(87) PCT Pub. No.: WO2016/003366
PCT Pub. Date: Jan. 7, 2016

(65) Prior Publication Data

US 2017/0138118 A1 May 18, 2017

(30) Foreign Application Priority Data

Jul. 1, 2014 (SG) ..... 10201403775Y

(51) Int. Cl.
*E06B 9/06* (2006.01)
*E06B 5/16* (2006.01)
(Continued)

(52) U.S. Cl.
CPC ..... *E06B 5/16* (2013.01); *A62C 2/065* (2013.01); *A62C 2/18* (2013.01); *E04B 1/941* (2013.01);
(Continued)

(58) Field of Classification Search
CPC ..... E06B 5/16; E06B 9/0638; E06B 9/0653; E06B 9/0676; E06B 9/17076; E06B 9/58;
(Continued)

(56) References Cited

U.S. PATENT DOCUMENTS 2,564,208 A * 8/1951 Michelman ..... E06B 9/13 160/7
3,987,600 A * 10/1976 Baehr ..... E06B 5/16 428/119
(Continued)

FOREIGN PATENT DOCUMENTS

EP 2674563 A1 12/2013
EP 2703594 A1 3/2014
(Continued)

OTHER PUBLICATIONS

International Search Report dated Aug. 17, 2015 for application PCT/SG2015/000132, filed on Jun. 26, 2015, and published as WO 2016/003366 on Jan. 7, 2016 (Applicant—Gliderol Doors (S) PTE., LTD. // Inventor—Wong) (4 pages).
(Continued)

*Primary Examiner* — Katherine W Mitchell
*Assistant Examiner* — Jeremy C Ramsey
(74) *Attorney, Agent, or Firm* — Ballard Spahr LLP

(57) ABSTRACT

Fire can spread extremely quickly within structures. To prevent this, fire doors or fire shutters are usually installed. However, security aspects of such doors or shutters are not renown. An attempt to alleviate this problem may be provided by an insulated fire panel shutter including a guide, adapted to receive a shutter and having one or more retractable members moveable between a retracted and extended position; a shutter, moveable between an open and closed position and formed from a plurality of panels each of which is moveable between a stowed and deployed position; their
(Continued)

arrangement being such that as the guide receives the shutter during shutter closure, the panel arrangement alters from a stowed side by side relationship to a deployed stacked end to end relationship.

19 Claims, 10 Drawing Sheets

(51) Int. Cl.

| | |
|---|---|
| ***E06B 9/58*** | (2006.01) |
| ***A62C 2/06*** | (2006.01) |
| ***A62C 2/18*** | (2006.01) |
| ***E04B 1/94*** | (2006.01) |
| ***E05F 5/00*** | (2017.01) |
| ***E06B 3/70*** | (2006.01) |

(52) U.S. Cl.
CPC ..... *E05F 5/00* (2013.01); *E06B 3/7015* (2013.01); *E06B 9/0638* (2013.01); *E06B 9/0676* (2013.01); *E06B 9/582* (2013.01); *E05Y 2201/21* (2013.01); *E05Y 2900/134* (2013.01); *E06B 2003/7042* (2013.01); *E06B 2003/7044* (2013.01); *E06B 2009/588* (2013.01)

(58) Field of Classification Search
CPC ..... E06B 9/582; E06B 2009/588; E06B 9/62; E06B 9/80; E06B 2009/807; A62C 2/065; A62C 2/18
See application file for complete search history.

(56) References Cited

U.S. PATENT DOCUMENTS

| | | | | |
|---|---|---|---|---|
| 4,258,517 | A * | 3/1981 | Hammond | E06B 3/285 160/269 |
| 5,239,777 | A * | 8/1993 | Husselton | E05D 13/1261 160/191 |
| 9,151,106 | B2 * | 10/2015 | Noble, III | E06B 5/164 |
| 2003/0033786 | A1 * | 2/2003 | Yulkowski | E06B 5/16 52/784.15 |

FOREIGN PATENT DOCUMENTS

| | | | |
|---|---|---|---|
| KR | 10-0919613 | B1 | 9/2009 |
| WO | WO-2011/016779 | A1 | 2/2011 |
| WO | WO-2012/099336 | A2 | 7/2012 |
| WO | PCT/SG2015/000132 | | 6/2015 |

OTHER PUBLICATIONS

Written Opinion dated Aug. 17, 2015 for application PCT/SG2015/000132, filed on Jun. 26, 2015, and published as WO 2016/003366 on Jan. 7, 2016 (Applicant—Gliderol Doors (S) PTE., LTD. // Inventor—Wong) (5 pages).

International Preliminary Report on Patentability dated Feb. 16, 2017 for application PCT/SG2015/000132, filed on Jun. 26, 2015, and published as WO 2016/003366 on Jan. 7, 2016 (Applicant—Gliderol Doors (S) PTE., LTD. // Inventor—Wong) (15 pages).

* cited by examiner

INSULATED FIRE PANEL SHUTTER

INSULATED FIRE PANEL SHUTTER

CROSS-REFERENCE TO RELATED APPLICATIONS

This application is a U.S. National Phase Application of International Application No. PCT/SG2015/000132, filed Jun. 26, 2015, which claims the benefit of Singapore Patent Application No. 10201403775Y, filed Jul. 1, 2014, each of which are hereby incorporated by reference in their entirety.

FIELD OF THE INVENTION

The present invention relates to an insulated fire panel shutter, in particular to one which can also serve as a security shutter.

BACKGROUND ART KNOWN TO THE APPLICANT

Fire can spread extremely quickly with the result that it can rapidly get out of control. In order to minimize this risk in structures, it is desirable that openings such as doors or windows in buildings; shafts in mines; and passageways in modes of transport used on land or sea, are provided with ways for preventing fire from passing through them and spreading to other areas. Fire doors or shutters tend to be used (e.g. SG 200905226-7) and these must be capable of resisting the effects of a fire for a period of time often stipulated by legislative regulations with the result that individuals can either safely escape the fire or if trapped, are relatively safe until the fire is dealt with. Nevertheless, enormous heat can be generated by such fires and heat transfer across the face of a fire door and in particular a fire shutter is possible given enough time. When subjected to the effects of fire, fire shutters can turn red hot and emit radiated heat to the other side of the shutter. In some cases, this radiated heat may be sufficient to cause material in the fire free area to eventually ignite and permit the fire to spread further. In addition, so-called 'fire doors' or 'fire shutters' tend not to be viewed as security doors or shutters. Accordingly, a need still exists to provide a fire shutter which meets both the requirements of preventing the initial spread of the fire and resisting heat transfer with the passage of time during a fire i.e. to act as a better heat insulator. In addition, a need also exists for a fire shutter which can also serve as a security shutter.

SUMMARY OF THE INVENTION

With the foregoing in view, the invention in one aspect resides broadly in an insulated fire panel shutter adapted to close off an area including:

a guide, adapted to receive a shutter and having one or more retractable members moveable between a retracted and extended position; and a shutter, moveable between an open and closed position and formed from a plurality of panels each of which is moveable between a stowed and deployed position;

their arrangement being such that as the guide receives the shutter during shutter closure, the panel arrangement alters from a stowed side by side relationship to a deployed stacked end to end relationship.

Preferably the shutter is adapted to bias the one or more of the retractable members into the retracted position as the shutter moves from its open to its closed position and when in the closed position, the shutter no longer biases the one or more retractable members enabling the one or more retractable members to move from the retracted to the extended position, enabling the guide to engage the front and rear face of the or each panel.

The retractable members are moveable between retracted and extended positions because they are fitted with a plurality of biasing hinges.

One retractable member may in principle be sufficient as in its extended position, it will narrow the clearance which exists between the guide and the thickness of the or each panel making up the shutter when the shutter is in its closed position. However, having a pair of opposed retractable members adapted to move from a retracted to expanded position to narrow the clearance from opposed sides of the guide would be more advantageous. This is because if only one retractable member was used, it would have to be able to urge the face of the panel it was not coming into contact with against the rest of the guide to narrow the clearance existing either side of the shutter, and given the mass of the or each panel the urging force would have to be very great. It would be better if the movement to narrow the clearance gap between the guide and either side of the shutter were carried out by moving retractable members towards opposed faces of the shutter.

Typically, shutters which include more than one shutter panel are usually designed so that each shutter panel is pivotally connected to another. In the present invention however, if multiple shutter panels are employed, it is preferable if at least some of the panels are not pivotally connected to each other. It is even more preferable if none of the panels were pivotally connected. Furthermore, conventional pivotally connected shutters tend only to be stowable in one of two manners.

Either the slats (or panels) of the shutter are rotatably stowed about an axle or translationally stowed along a straight or curved guide when the shutter is in the open position. If the guide is straight, the movement of the panels will be a purely translational movement. If the guide is curved the movement will involve both translation and either a degree of rotation or revolution. In respect of the present invention however preferably, during movement of the shutter, at least one panel undergoes translational movement in two directions, the final position of the panel being parallel with but within a different plane to the first.

Such an arrangement would allow the panel arrangement to change from a side by side relationship in a 'door open' position to a stacked top to bottom relationship in the 'door closed' position during deployment of the panels to form the shutter thus closing off the area.

Such a form of movement would be advantageous over for example, conventional translational stowing as it is likely to involve space (if not volume) saving especially if the side by side arrangement is one where the front face of one panel faces the rear face of another and more than one panel undergoes the same type of movement resulting in the stacking of panels.

Preferably, the insulated fire panel shutter is provided with means adapted to enable at least some or each of the panels to be stowed in a parallel overlying front face to rear face facing relationship when the shutter is in the open position.

This is preferably achieved by a pair of opposed sloping (relative to the horizontal) shelves. The slope may be friction compensating or greater and a plurality of such shelf stowed panels would be in a staggered relationship if each of the panels were of the same size and shape.

Preferably, the insulated fire panel shutter is provided with a driver motor operatively connected to the panels and means to arrest the rate of panel descent during shutter formation in the event of a motor gear box failure.

Preferably, the insulated fire panel shutter incorporates biasing means adapted to provide a bias to the shutter as the panels forming the shutter move from their stowed to their deployed position. Such a bias would not only enable a smaller motor to be used to move the panels once having formed the shutter from their deployed back to their stowed position, but the bias would (via an appropriately placed pull-chain) also assist someone trapped on the wrong side of the shutter to lift the shutter sufficiently to enable them to roll, 'commando-crawl' or otherwise make their way to the right side of the shutter before allowing the shutter to close again.

Preferably, the means to arrest the rate of panel descent during shutter formation is the biasing means.

Typically, a counterweight system would be used to provide such a biasing means, however, any form of counterweight system requires a relatively large amount of space to store the counterweights and space may be at a premium. Accordingly, it is preferable if the biasing means is provided by one or more torsion springs operatively connected to the transmission shaft. Such a biasing means occupies far less space and the ability (if required) to use more than one torsion spring provides greater flexibility in the fabrication of the insulated fire panel shutter, as they tend to be bespoke items. Accordingly, the ability to vary the number, length and/or type of torsion spring to fit a particular set of circumstances would be useful. In such form, the transmission shaft may preferably be circular in cross section. However preferably, the transmission shaft is polygonal (ideally square or hexagonal) in cross section. Such anon-circular cross sectional arrangement will enable a fixture securing the winding end of the or each torsion spring to the transmission shaft with more 'bite' as it will be less likely to counter-rotate over time once the stored torque has been applied.

Preferably, the or each torsion spring is so marked as to be able to provide an indication of the number of turns which have been applied to the or each spring, thus providing an indication of its stored torque/potential energy.

In order to prevent or reduce the possibility of heat transfer during a fire, preferably, the guide is fitted with one or more intumescent ships. In such form, at least one intumescent strip is fitted to a retractable member.

There are several ways in which the bias exerted on the or each retractable member may be eliminated, for example, the retractable member may possess an aperture into which the member exerting the bias moves into once the shutter is in the closed position. However, preferably, the or each retractable member is fitted with a camber which eliminates the bias exerted on the or each retractable member by the shutter when the shutter is in the closed position, enabling the movement of the or each retractable member from its retracted to its extended position when the shutter is in its closed position.

The camber has the advantage that the shutter may be opened or closed easily during day to day operations simply by reversing the direction of the drive motor. If an aperture were used instead of a camber, a further means of retracting the member exerting the bias from the aperture would need to be installed and operated before the shutter could be opened again. The panel could simply comprise a normal panel employed in conventional fire panel shutters. However, the panel of the present invention has been specifically designed for use with (and thus forms part of) the present invention. However, the panel itself may be considered to be new and inventive in its own right and could be used with a conventional fire panel shutter.

Accordingly, preferably, the or each panel is an insulated metal panel. In such form, the metal panel includes a) frame having a front and rear face;
b) a sheet of material fitted to and extending across the front and rear faces of the frame; and
c) a thermally resistant wadding housed within the volume between the sheets of material and perimeter of the frame.

Preferably, the frame is metal and the exterior faces of the sheets of material are covered with a metal sheet in a sliding fit arrangement. Such an arrangement has been found to reduce thermal conductivity through the panel to a minimum compared with conventional panels forming fire shutters as there are no screws securing the sheets to the frame.

In fact there is no metal to metal contact between the sheets and the frame, reducing any heat transfer between, them by conduction to zero.

Preferably, the panel is formed from a plurality of metal components, which do not contact each other in the finished panel to form an insulated metal panel. This has the advantage of preventing conduction of heat from one metal component to another and from one face of the panel to the other. In such form, the metal is steel and includes a box frame and front and rear steel sheets. In such form, the front and rear steel sheets are folded and fitted to a flame retardant board. Such an arrangement of a box frame, together with front and rear sheets made from metal (ideally steel) also provide a level of security not typically available to (for example) a normal fire door when closed.

This is because the ability to 'kick down' or 'sledge hammer through' a conventional locked fire door is relatively facile but a steel construction including a box frame and front and rear sheeting is another matter. The box frame could be strengthened by, for example, including diagonal or a number of horizontal or vertical metal (ideally steel) cross bars.

Preferably the wadding comprises a ceramic material and a silica fabric material. It has been found that the use of multiple types of wadding components better prevent heat transfer through the material than just a single type of wadding.

Preferably, when the shutter is closed, the metal components forming each of the panels do not contact each other. Such an arrangement has the advantage of minimizing heat transfer between panels by conduction. In such form, the metal components between adjacent panels are kept apart by a separating member. Again, in such form, the separating member is formed from a ceramic material.

Preferably, movement of the panels to form the shutter is actuated by a chain and sprocket mechanism powered by a driver motor. This is beneficial over hand actuation as the shutter is heavy and would be difficult to open if it were not powered in some way.

The present invention may be used to close off a vertical shaft for example in a mine. In such form, the guide would be sloped towards the horizontal. However, the invention is more usually to be associated with conventional horizontal passageways, doorways or the like.

Preferably therefore, the guide will be a vertical guide in its normal attitude of operation.

Preferably, the guide includes two metals as it is preferable if precision portions of the guide are made from material which can be extruded whilst non precision portions do not have to be. In such form, the extrudable material is aluminum.

Although aluminium has a relatively low melting point (around 660° C.) and as a result would normally be considered unsuitable as a material associated with a fire barrier, it has the advantage that as it may be extruded, it can be manufactured to high engineering tolerances.

Such high tolerances are required if the clearance fit has to be precise.

The aluminium in the guide is intended to be strong enough to withstand normal wear and tear during everyday use and in the event of a fire, once the insulated fire panel shutter has closed, it will not matter whether the aluminium component melts or buckles under the heat.

To save on weight and expense, instead of using solid metal for the non-extruded portion of the guide, fire rated cement board covered with metal could be used instead.

Preferably, the panels forming the shutter are provided with complementary inter-locking members adapted to lock the panels together once the shutter is formed. Such an arrangement serves to add a further level of security to the shutter as without this form of locking, it is conceivable that the panels may be sufficiently flexed at their midpoint to enable entry by an intruder if the shutter is down in a security rather than a fire shutter capacity.

Although the number and/or placement of the inter-locking members need not extend across the entire length of each panel, in order for example to save on the cost of the production of a panel, in such form, the complementary inter-locking members extend across the length of each panel.

Further, in such form, the complementary inter-locking members are in the form of a tongue and groove arrangement.

Preferably, the shutter once formed is also provided with a flexible flame baffle sheet adapted to span any gap between the top of the shutter once formed and the top of a doorway to which the insulated fire panel shutter is fitted to. Such an arrangement will thus provide an additional barrier in this 'gap area' to any flames, heat and/or smoke in the event of a fire.

In another aspect, the invention resides broadly in a building or structure incorporating an insulated fire panel shutter as specified herein.

BRIEF DESCRIPTION OF THE DRAWINGS

In order that the invention may be more readily understood and put into practical effect, reference will now be made to the accompanying sheets of drawings wherein.

DESCRIPTION OF THE PREFERRED EMBODIMENTS

Figure 1:
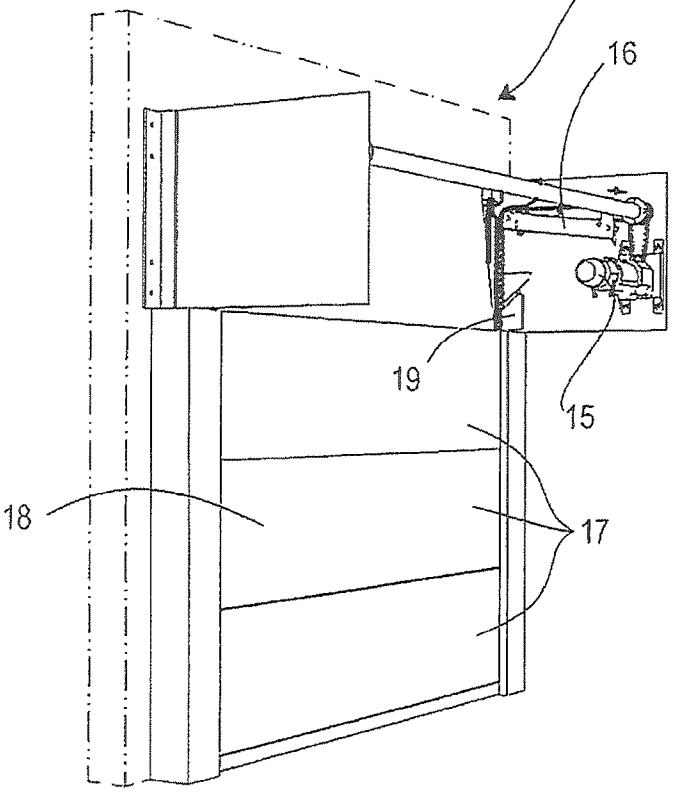
FIG. 1 is a perspective view of an insulated fire panel shutter of the present invention in its closed position and fittable to a doorway with its protective cover removed to expose the shutter panel storage facility, sprocket and chain mechanism and drive motor which operates the shutter.

FIG. 1 is a perspective view of an insulated fire panel shutter generally referenced 10, fittable to a doorway and adapted to close off an area in the event of a fire. It is shown in its closed position devoid of a protective cover to show some of its moving/working parts. The insulated fire panel shutter 10 includes a pair of opposed mild steel panel cassettes 11 each being fitted to one end of a vertical (steel covered fire rated cement board) guide 12. Mounted to each cassette 11 is a chain and sprocket assembly 13 which is connected to opposite ends of a steel transmission shaft 14 drivable by a drive motor 15 mounted on one of the cassettes 11.

Figure 2:
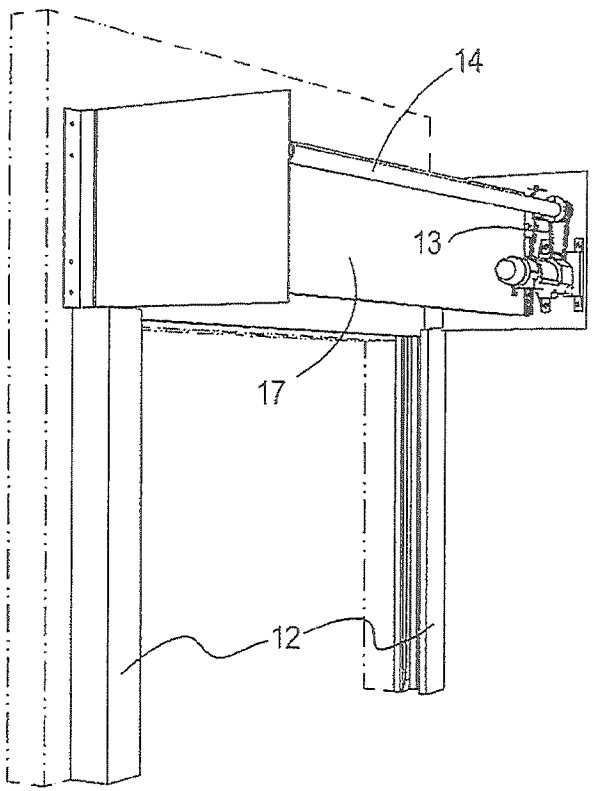
FIG. 2 is a perspective view of the insulated fire panel shutter of FIG. 1 in its open position showing panels making up the shutter of the insulated fire panel shutter in their stowed position.
Figures 3, 4:
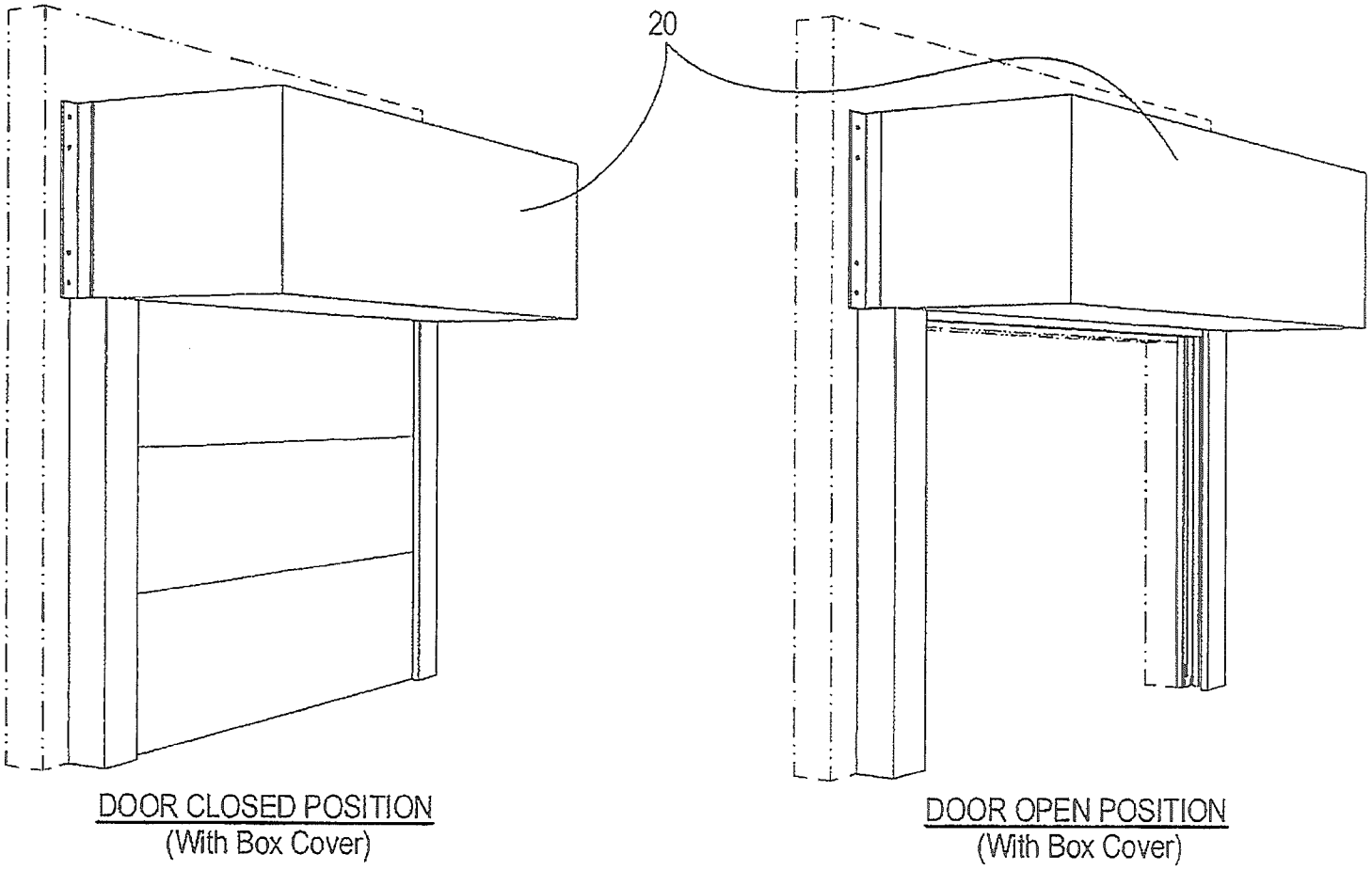
FIG. 3 is a perspective view of the insulated fire panel shutter of FIG. 1 in its closed position with the protective cover fitted.
FIG. 4 is a perspective view of the insulated fire panel shutter of FIG. 1 in its open position with the protective cover fitted.
Figure 6:
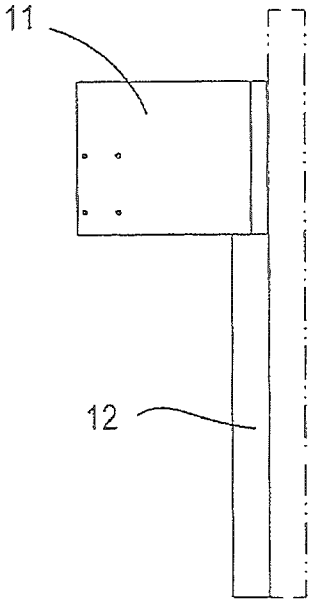
FIG. 6 is a side elevation of the insulated fire panel shutter of FIG. 1 in its closed position.

In addition, a panel shelf 16 is also mounted to each cassette 11 in an opposed arrangement which act as a storage facility for the insulated panels 17 (see FIG. 2) used to form the shutter 18 of the insulated fire panel shutter 10 when in the open position. Each cassette 11 is also fitted with a panel guide 19 adapted to direct the movement of stowed panels 17 in use (see later). FIGS. 3 and 4 show the insulated fire panel shutter 10 with the protective cover 20 on in its closed and open position respectively.

In the event of a fire the shutter 18 in its closed position will offer a degree of protection to the components mounted to the cassettes 11, however, an additional degree of protection is provided by a flexible flame baffle sheet 21 made of fire rated fabric which spans the gap between the two cassettes 11 and downwardly depends from the top of the insulated fire panel shutter 10 in front of the chain and sprocket assembly 13.

Figure 7:
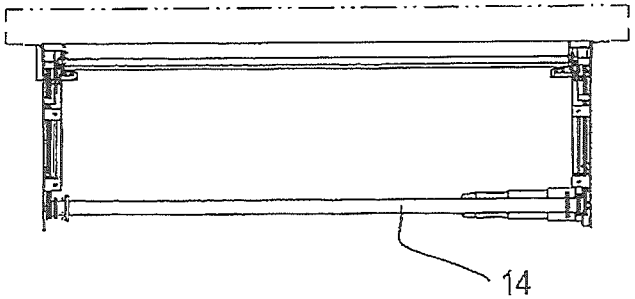
FIG. 7 is a plan view of the insulated fire panel shutter of FIG. 1 in its closed position with the protective cover removed.
Figure 5:
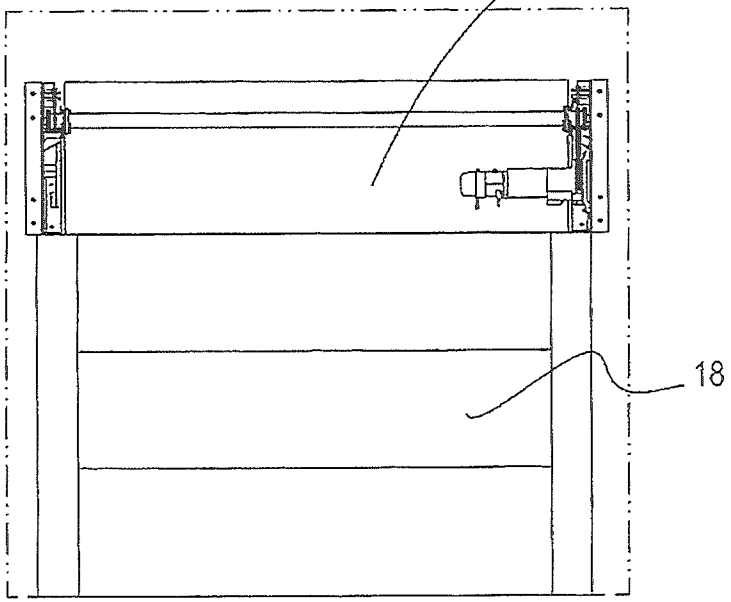
FIG. 5 is a rear elevation of the insulated fire panel shutter of FIG. 1 in its closed position with the protective cover removed.
Figure 11:
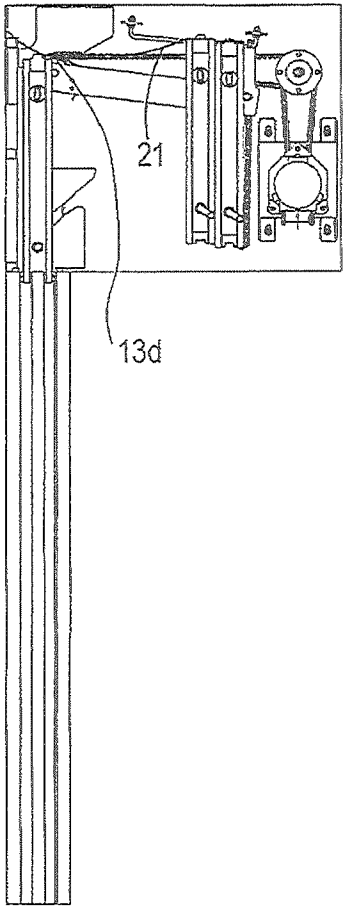
FIGS. 8-11 are sectional views of the insulated fire panel shutter of FIG. 1 during various stages of opening/closing of the shutter (without separator blocks {see FIGS. 18 & 19} in place to show the chains).
Figure 10:
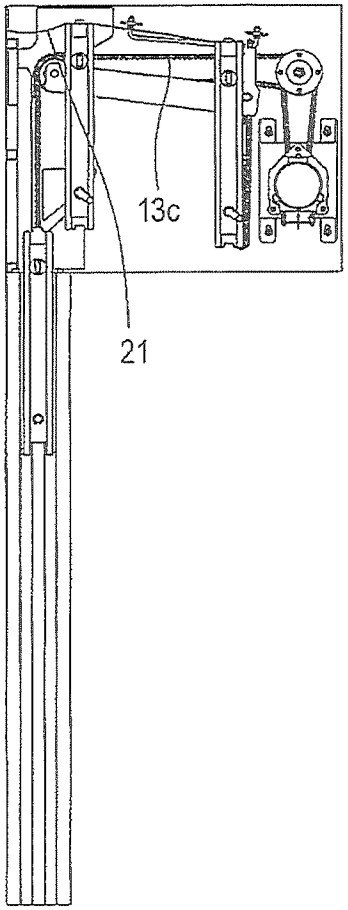
Figure 9:
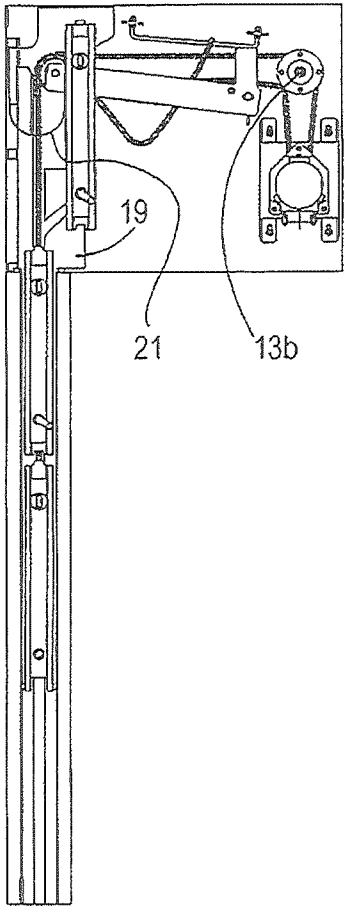
Figure 8:
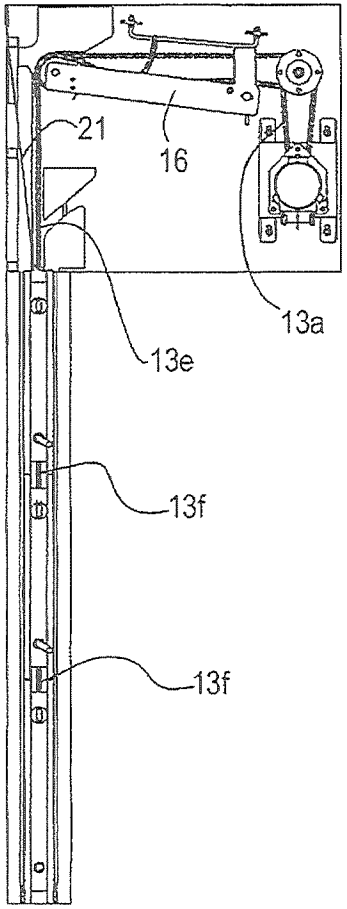

The top of the sheet 21 in its normal attitude of operation being fitted to a rod connected to the top of the insulated fire panel shutter 10 and spanning the gap between the cassettes 11, whilst the bottom of the sheet 21 is connected to the top of the last of the insulated panels 17, this final panel 17 being adapted to form the uppermost panel of the shutter 18 in the shutter's closed position. This baffle sheet 21 has the advantage of being able to bridge any existing gap which may be present between the fire panel shutter 10 and the top of the doorway that it is fitted to. Such a sheet 21 will thus provide an additional barrier in this 'gap area' to any flames, heat and/or smoke and is shown more clearly in FIGS. 5 and 7.

FIGS. 8-11 show how each of the panels 17 are connected to the chain and sprocket assembly 13. As shown, the cassette 11 containing the drive motor 15 includes a downwardly depending endless chain 13*a* linking the drive motor 15 to a motor sprocket (hidden from view) and one sprocket of a double sprocket 13*b* and a trans-mission chain 13*c* connecting the second sprocket of the double sprocket 13*b* to a second sprocket of double sprocket 13*d*. A free chain 13*e* connected to the cassette 11 at one end, rides over the first sprocket of double sprocket 13*d* and is linked to a side wall of a panel 17. Another section of free chain 13*f* connects this panel 17 to the next panel 17 and this process repeats until each of the panels 17 are connected. The same arrangement (save for the endless chain connecting the drive motor 15 to the double sprocket 13*b*) occurs with the other cassette (see also FIGS. 20-22).

FIGS. 8-11 also show how the shutter 18 is formed as the panels 17 stowed in a parallel staggered overlying front face to rear face facing relationship on the shelves 16 move along shelves 16 and (guided by panel guides 19) down the guides 12 when actuated by the drive motor 15.

Figures 12, 13, 14, 15, 16, 17:
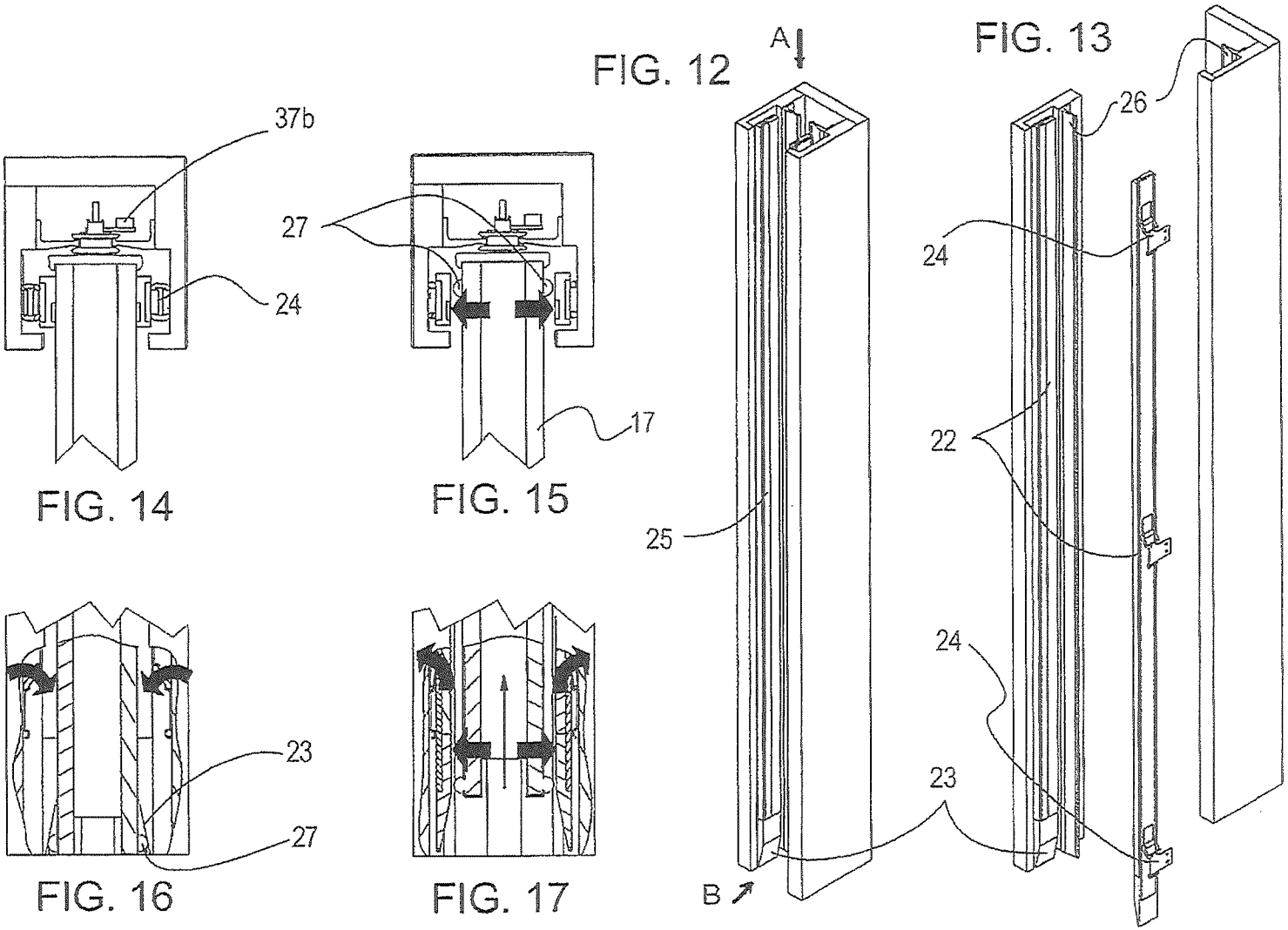
FIG. 12 is an isometric view of one of the guides forming part of the insulated fire panel shutter of FIG. 1.
FIG. 13 is a partially exploded view of the guide of FIG. 12.
FIG. 14 is a sectional view through the upper end portion of the guide of FIG. 12 when the insulated fire panel shutter is in its closed position showing opposed retractable members in their extended position.
FIG. 15 is a sectional view through the upper end portion of the guide of FIG. 12 when the insulated fire panel shutter is in its open position, showing the opposed retractable members of FIG. 14 biased into their retracted position.
FIG. 16 is a sectional view through the lower end portion of the guide of FIG. 12 (without separator blocks {see FIGS. 18 & 19} in place) when the insulated fire panel shutter is in its closed position, showing the opposed retractable members of FIG. 14 in its extended position due to opposed cambers at the lower end of the guide.
FIG. 17 is a sectional view through the lower end portion of the guide of FIG. 12 (without separator blocks {see FIGS. 18 & 19} in place) when the insulated fire panel shutter is beginning to open, showing the opposed retractable members of FIG. 14 beginning to be biased into their retracted position.

FIGS. 12 and 13 show one of the guides 12 in more detail. Each guide 12 once assembled comprises essentially an elongate square 'C' shaped member when seen in cross section with a pair of opposed retractable members 22 housed within and forming part of the guide 12. Each retractable member 22 comprises a series of contiguous ceramic plates bolted to an elongate steel strip that extends along the length of the guide 12 and towards its bottom end each retractable member 22 terminates with a ceramic plate camber 23.

Each retractable member 22 is connected to the rest of the guide 12 by three biasing hinges 24 enabling each retractable member 22 to move between a retracted and extended position relative to the rest of the guide 12. The hinges 24 bias each retractable member 22 towards the extended position. The front face of each retractable member 22 is fitted with a strip of intumescent material 25 and adjacent each retractable member 22, is an aluminium guide rail 26.

The lowest panel 17 of the shutter 18, where it passes between the guides 12 is fitted at the base of its front and rear faces with a ceramic biasing member 27 (four in all). The function of these biasing members 27 is to bias each pair of opposed retractable members 22 into their respective retracted position as the shutter 18 moves from its open to its closed position.

When the lowest panel 17 of the shutter 18 reaches the ground the space created by the camber 23 is slightly greater than the thickness of the ceramic biasing member 27 enabling each retractable member 22, to move from its retracted to its extended position, permitting the guide 12 to engage the front and rear face of each panel 17 making up the shutter 18 (see FIGS. 14-17).

Figure 19:
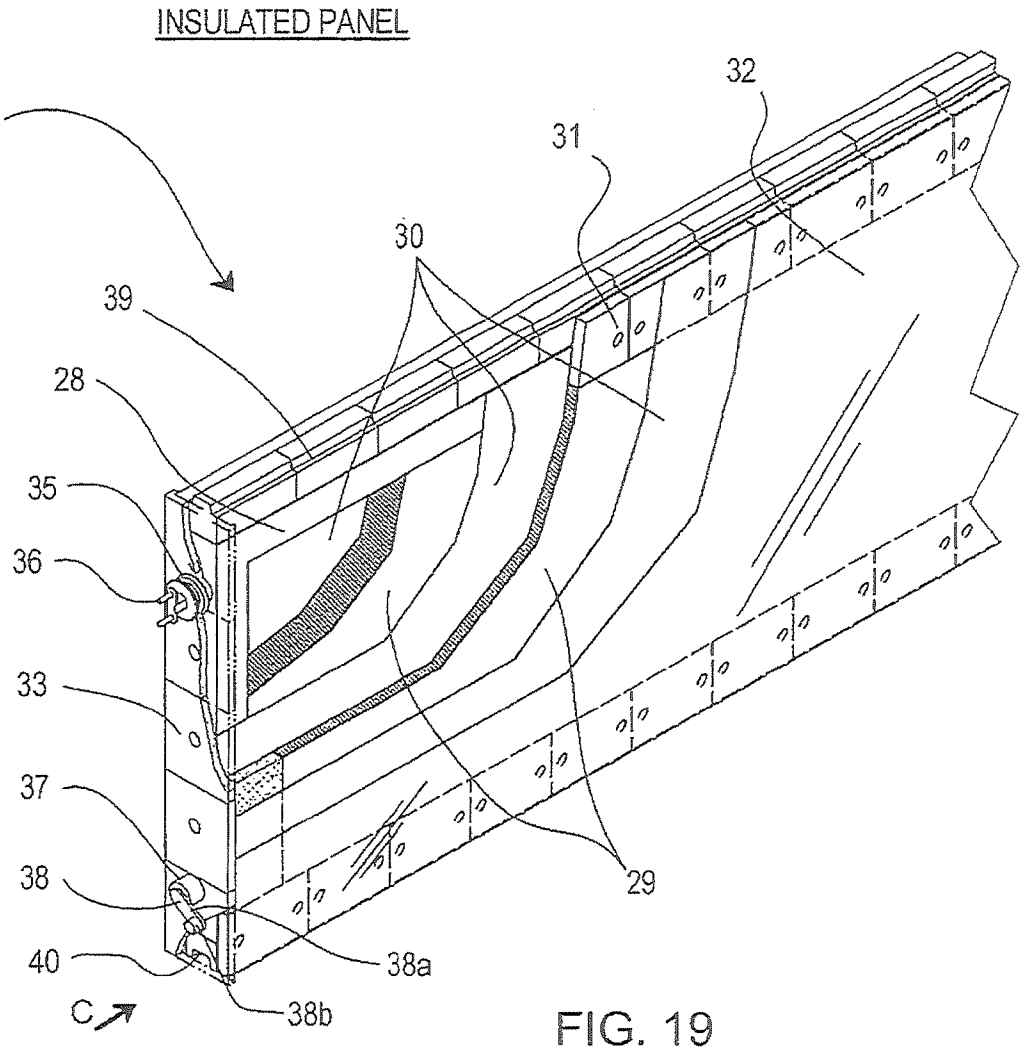
FIG. 19 is an isometric sectional view through part of the insulated panel of FIG. 18 showing the arrangement of materials employed in the make-up of the panel inclusive of separator blocks.
Figure 18:
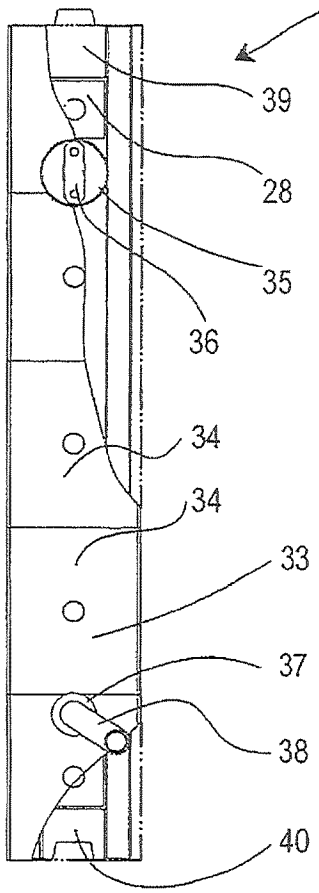
FIG. 18 is a side elevation of a panel forming the shutter panel of the insulated fire panel shutter of FIG. 1 inclusive of separator blocks.

FIGS. 18 and 19 show more detail of the nature of one of the insulated panels 17. As can be seen, each panel 17 is formed from a rectangular steel box frame 28, the volume defined by the inner perimeter of the frame being filled with a ceramic blanket wadding 29. A sheet of silica fabric material 30 extends across both the front and rear faces of the frame 28 to trap the wadding 29 located within the frame 28. A further ceramic blanket 29 also extends across both the front and rear faces of the frame 28 over the silica fabric material 30. The blankets 29 and materials 30 are secured to the front and rear faces of the frame 28 by a series of elongate ceramic plates 31 that are screwed to the frame 28.

The series of elongate ceramic plates 31 although flush with the width of the frame 28, extend slightly beyond the top and bottom of the frame 28. A further sheet of silica fabric 30 extends across the entire exterior face of each of the ceramic framed ceramic blankets 29 and is secured to the ceramic frame 31 using the same screws which bolt the ceramic frame 31 to frame 28. Finally, the front and rear face of the panel 17 is covered in a skin of sheet steel 32.

The top and bottom portions of each sheet 32 each possess two 90 degree folds to form respective and shapes in cross section, enabling each sheet 32, in a 'sliding fit', to be fitted to each respective set of the upper and lower ceramic plates 31. The ends of the respective 'n' and 'u' shaped folds of each sheet 32 are so sized and shaped as not to contact frame 28 once the sheets 32 have been slid into place (and also after any expansion may have taken place after heating in for example, the event of a fire).

A ceramic end cap 33 composed of a series of elongate ceramic plates 34 (which are 'n' shaped in cross section) is screwed to opposing side walls of the frame 28 to prevent the sheets 32 from sliding off, the end cap 33 being flush with the top and bottom of the series of elongate ceramic plates 31.

The opposed side walls of each panel 17 also include opposed upper guide rollers 35 fitted with a pair (upper and lower) of lifting shafts 36 and opposed lower guide rollers 37 each fitted with a lead-in panel guide 38. One end of the free chain 13*e* connected to the cassette 11 connects to the upper lifting shaft 36 and free chain 13*f* connects to the lower lifting shaft 36 and the upper lifting shaft of the next panel 17.

The lead in panel guide 38 is somewhat similar to an old fashioned rotatable handle used to wind car windows up and thus consists of two components the arm 38*a* and the handle 38*b*. The purpose of the arm 38*a* is to distance the handle 38*b* or otherwise 'offset' the handle 38*b* with respect to the rest of the guide roller 37 enabling free chain 13*f* to pass vertically down the side wall of the panel 17 without interfering with the handle 38*b*.

In addition, a plurality of elongate ceramic separators 39 protrude beyond the top of the sheet 32 covered ceramic plates 31 and, 'sit' on the top wall of frame 28 of all but the uppermost panel 17. These contiguous separators 39 in cross section are similar to an inverted 'T' in shape and form the tongue in an otherwise tongue 39 and groove 40 system. A similar plurality of elongate ceramic separators 40 are also screwed to the bottom wall of each frame 28, are 'n' shaped in cross-section and protrude beyond the bottom of the sheet 32 covered ceramic plates 31.

The arrangement between respective tongue 39 and groove 40 ceramic separators is such that when respective separators 39, 40 come into contact with each other i.e. when one panel 17 sits on another, during shutter 18 formation, there is an air gap between the fold of steel 32 running along the top face of the ceramic plates 31 of the lower panel 17 and the fold of steel 32 running along the bottom face of the ceramic plates 31 of the adjacent panel 17 above it. This air gap prevents conduction of heat between panels 17.

In addition the design of the tongue 39 and groove 40 is such that the walls of the upwardly extending leg of the inverted 'T' are sloping inwardly slightly and contact between the tongue and groove only occurs between the feet of the groove 40 and the base of the inverted 'T' 39. This arrangement minimizes the risk of the tongue 39 and groove 40 system 'sticking' when the shutter 10 is being opened again.

Although the plates 31 and 34 and the separators 39 and 40 are shown in a contiguous arrangement in this embodiment, in an alternative non illustrated embodiment, they need not be and as such their number may be reduced to save costs.

Figure 22:
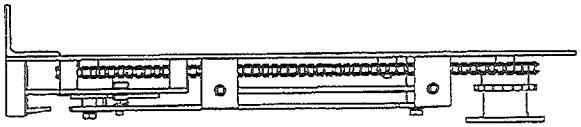
FIG. 22 is a plan view of the cassette panel of FIG. 20 showing the cassette and chain and sprocket drive mechanism.
Figure 21:
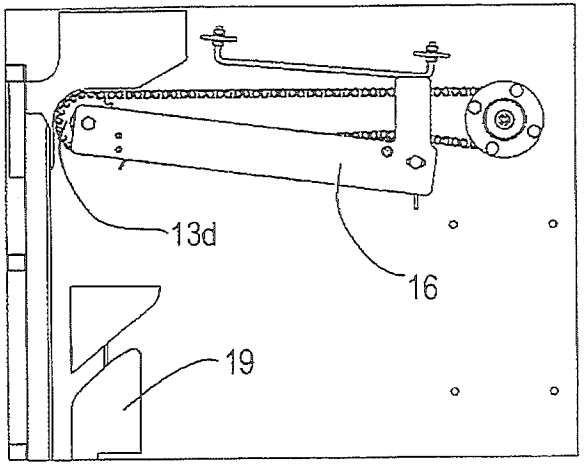
FIG. 21 is a side elevation of the cassette panel of FIG. 20 showing the cassette and chain and sprocket drive mechanism.
Figure 20:
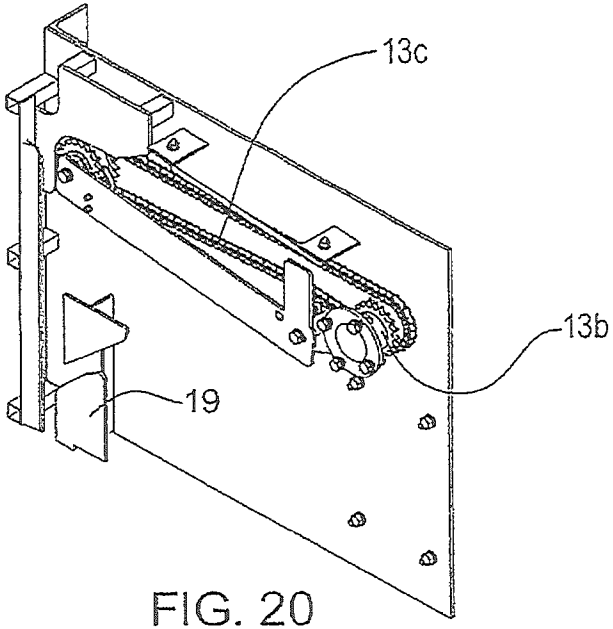
FIG. 20 is an isometric sectional view through the insulated fire panel shutter of FIG. 1 to show one of the cassette panels housing a chain and sprocket drive mechanism for the shutter panel.

FIGS. 20-22 show one of the cassettes 11 in more detail albeit with the drive motor 15 and its endless connecting chain 13*a* to the double sprocket 13*b* missing.

In operation, assuming the insulated fire panel shutter 10 is in its open position, upon actuation of the drive motor 15, motor sprocket and the double sprocket 13*b* and transmission shaft 14 begin to rotate in an anti-clockwise direction causing the transmission chain 13*c* and double sprocket 13*d* to similarly rotate. As a consequence, the first panel 17, connected by the free chains 13*e*, moves from the cassette 11 and as it begins to lower, it engages the guides 12 enabling its ceramic biasing members 25 to retain the retractable members 22 in their retracted position,. As it does so the opposed upper guide rollers 35 eventually pass between and thus engage with the aluminium guide rails 26. Soon afterwards, the next panel 17 in the sequence (connected to the first panel by free chain 13*f*) and also stowed on the shutter panel storage facility begins to ride up the angled slope of the shelves 16 (via the upper guide rollers 35) and the lead in panel guides 38 eventually engage with the panel guides 19 to aid in directing the lower end of this next panel 17 such that the lower guide rollers 37 are able to pass between and thus engage with the aluminium guide rails 26. At this point, this next panel's translational motion changes direction from being one in the direction up the slope of the shelves 16 to vertically downward, whereupon the upper guide rollers 35 eventually pass between and thus engage with the aluminium guide rails 26.

The descent of this next panel 17 terminates when the feet of the separators 40 on the lower wall of the frame 28 of this panel 17 contact the base of the inverted 'T' of the separators 39 on the upper wall of the frame 28 of the lower panel 17 to leave an air gap between the metal portions of each panel 17.

During this time the next panel in the sequence is following on from the previous one, the final panel 17 connected to the blanket 21 steadily moving as well.

As the biasing members 27 of the first panel 17 pass the cambers 23, the biasing hinges 24 are able to bias the retractable members 22 into their extended positions to contact the now fully formed and fully closed shutter 18, with the blanket 21 deployed as well. In the event of a fire, the heat will trigger the intumescent material 25 and this will generate a seal between the guides 12 and the shutter 18. Under normal operating conditions, to open the shutter 18, the drive motor 15 is simply put into reverse.

Figure 23:
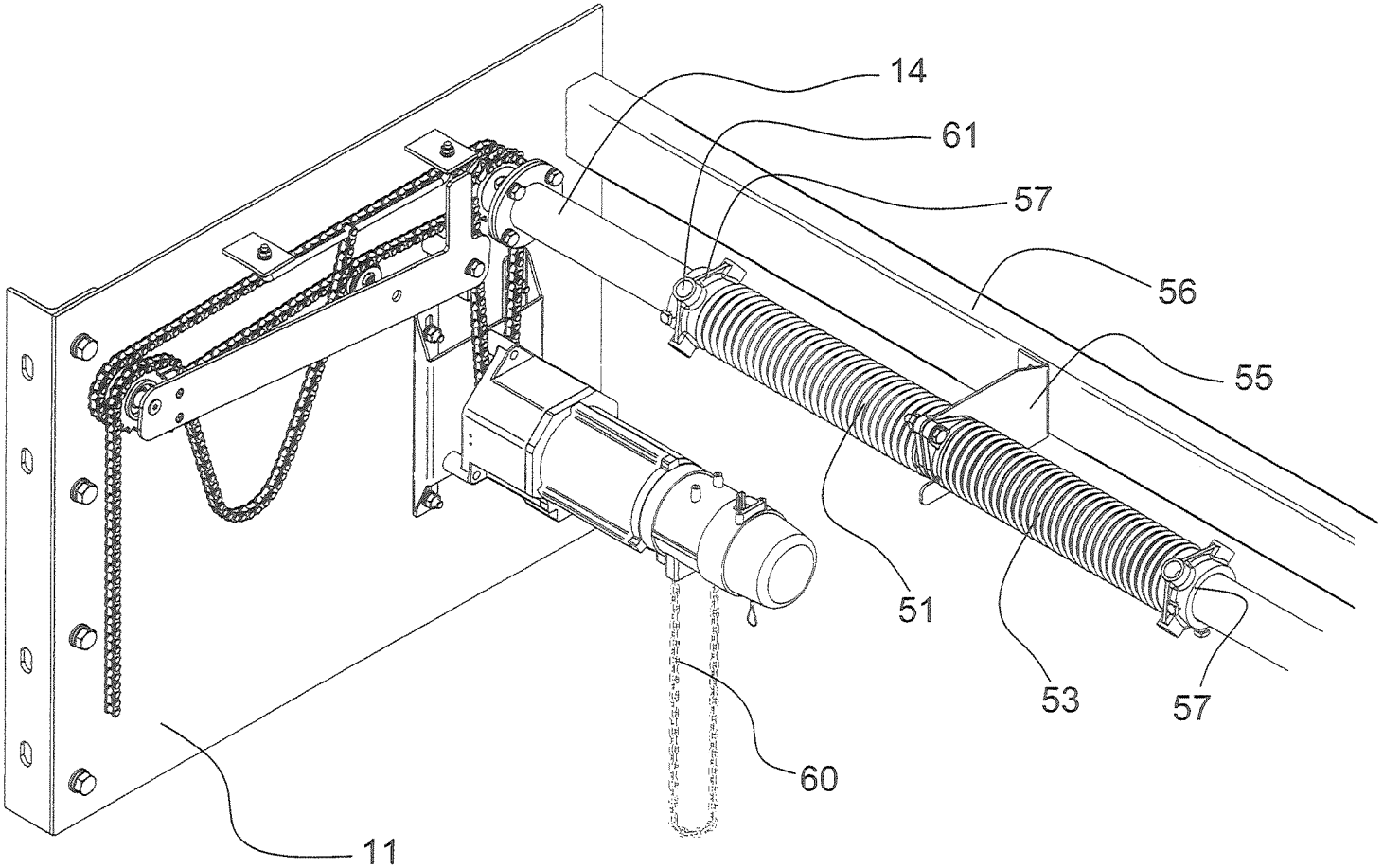
FIG. 23 is a perspective view of an alternative embodiment of the motor containing side of the insulated fire panel shutter similar to that shown in FIG. 1 showing a right handed and left handed pair of torsion springs fitted to the transmission shaft.
Figure 24:
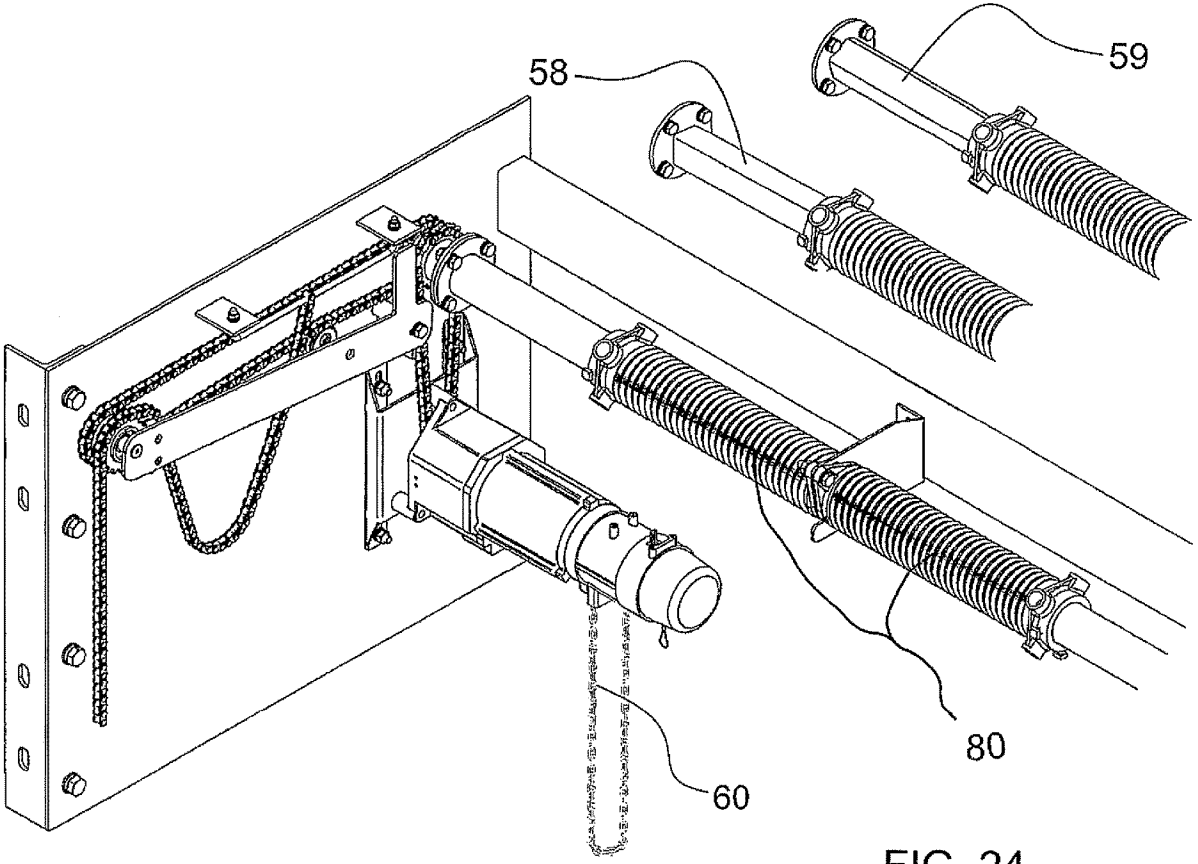
FIG. 24 is a perspective view of the embodiment shown in FIG. 23 but also showing alternate types of transmission shaft with complementary fixtures securing the winding end of the or each torsion spring to the transmission shaft.
Figure 25:
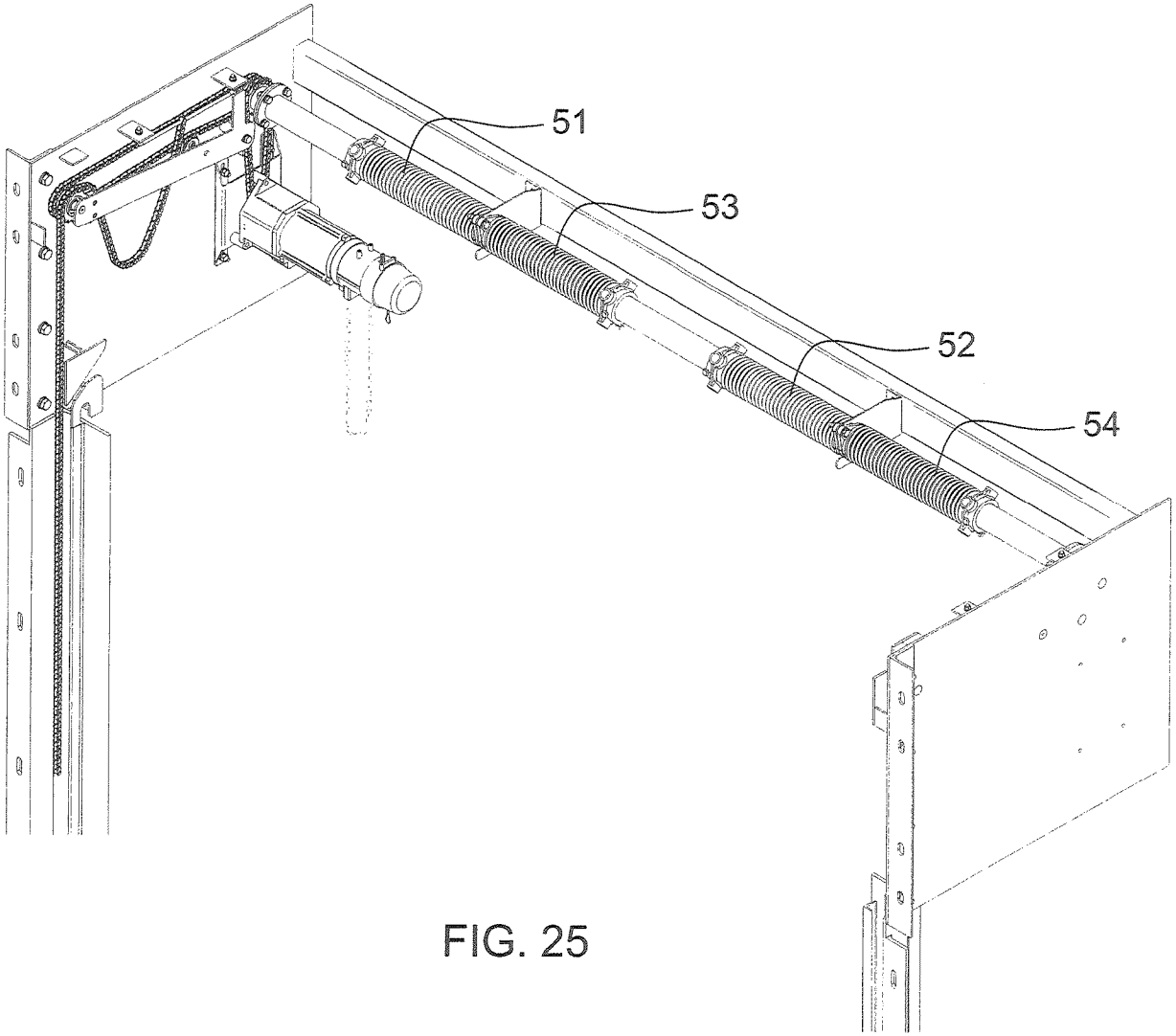
FIG. 25 is a perspective view of the embodiment shown in FIG. 23 encompassing both sides of the insulated fire panel shutter with its protective cover removed.

FIGS. 23-25 show a variation to the general design of the insulated fire panel shutter, generally referenced 50.

This variant incorporates a bias in the form of four marked torsion springs 51-54 to counter-balance the panels 17 of the shutter 18. Two of the torsion springs 51, 52 are right handed (RH) springs and the other pair 53, 54 are left handed (LH) springs. One end of each respective pairs of torsion springs is securely fastened to an arm 55 which is in turn fitted to a bar 56 connected to each cassette 11.

The other end of each respective torsion spring is fitted to a fixture 57 (reminiscent of an anchor windlass on an old sailing ship) which is complementary with and securely fastened to the transmission shaft 14. With such an arrangement of RH,LH; RH,LH, on the transmission shaft 14 both pairs of springs 51,53;52,54 will wind up or unwind together, depending on the rotation of the transmission shaft 14.

FIG. 24 shows alternate transmission shafts which are square 58 or hexagonal 59 in cross-section and these potentially offer better 'bite' for the complementary fixtures 57 fitted to them, as with a polygonal cross-section to the transmission shaft, there will be less chance of counter rotation from the stored torque energy in the or each torsion spring 51-54.

The purpose of the springs 51,53;52,54 is to enable either a smaller drive motor to be employed than would otherwise be required as the springs 51,53;52,54 assist with the opening and closing of the insulated fire panel shutter 50 or the same 'standard' drive motor 15 to enable particularly heavy panels 17 to be moved and formed into the shutter 18. The torsion springs 51-54 also act as a safety feature in this embodiment as they will prevent the panels 17 from crashing down should drive motor 15 fail. They will also extend the longevity of the drive motor 15 as it will not need to work as hard to raise the panels 17 of shutter 18.

A pull chain 60 of sufficient length is connected to the motor and is also shown in FIGS. 23-25 the purpose of which is to release the motor brakes and thus disengage the drive motor 15 from the gear box to allow the motor sprocket to move freely.

When the drive motor 15 is actuated, the shutter 18 is allowed to form in a manner previously described thus closing the insulated fire panel shutter 50.

In order to initially apply the appropriate amount of torque to the springs 51,53;52,54, one end of a rod (not illustrated) is inserted into one of the apertures 61 of the fixture 57 (which is at this point free to rotate) and is wound such that the appropriate torsion spring begins to store torque, and when sufficient rotations of the torsion spring have been completed (indicated by the marks 80 on the torsion spring 51) the fixture 57 is securely fastened to the transmission shaft 14.

This process is repeated for each torsion spring 52-54 but the number of turns need not be identical.

Accordingly, in this embodiment, upon actuation of the drive motor 15, when the fire panel shutter 50 is in its open position, torque in each of the springs 51,53;52,54, will slowly build up as the shutter 18 forms.

The invention claimed is:

1. An insulated fire panel shutter adapted to close off an area, the insulated fire panel shutter including:

a guide adapted to receive a shutter and having one or more retractable members moveable between a retracted position and an extended position, wherein each retractable member of the one or more retractable members possesses a respective camber; and a shutter moveable between an open position and a closed position and formed from a plurality of panels, each panel being moveable between a stowed position and a deployed position, wherein the guide, the shutter, and the one or more retractable members are arranged such that, as the guide receives the shutter during shutter closure, the panel arrangement alters from a stowed side by side relationship to a deployed stacked end to end relationship, wherein the shutter is adapted to bias the one or more retractable members into the retracted position as the shutter moves from the open position to the closed position, and when in the closed position, the shutter no longer biases the one or more retractable members enabling the one or more retractable members to move from the retracted position to the extended position, enabling the guide to engage a front face and a rear face of each panel of the plurality of panels, wherein the camber of each retractable member of the one or more retractable members is adapted to eliminate the bias exerted on the respective retractable member by the shutter when the shutter is in the closed position, and wherein some or each of the plurality of panels are stowed in a parallel overlying front face to rear face facing staggered relationship when the shutter is in the open position.

2. The insulated fire panel shutter as claimed in claim 1, wherein the insulated fire panel shutter is provided with a driver motor operatively connected to the plurality of panels, and biasing means adapted to provide a bias to the shutter as the plurality of panels forming the shutter move from the stowed position to the deployed position and to arrest a rate of panel descent during shutter formation in the event of a motor gear box failure.

3. The insulated fire panel shutter as claimed in claim 2, wherein the biasing means is provided by one or more torsion springs operatively connected to a transmission shaft.

4. The insulated fire panel as claimed in claim 3, wherein the transmission shaft is circular in cross-section.

5. The insulated fire panel shutter as claimed in claim 3, wherein each torsion spring of the one or more torsion springs is directly marked to provide an indication of the number of turns which have been applied to the respective torsion spring, thus providing an indication of its stored torque or potential energy.

6. The insulated fire panel shutter as claimed in claim 1, wherein each retractable member of the one or more retractable members of the guide is fitted with one or more intumescent strips.

7. The insulated fire panel shutter as claimed in claim 1, wherein each panel of the plurality of panels includes a plurality of metal components, which do not contact each other in the panel to form an insulated metal panel, and wherein the insulated metal panel includes:

a) a frame having a front face and a rear face;

b) a first sheet of material fitted to and extending across the front face of the frame and a second sheet of material fitted to and extending across the rear face of the frame; and c) a thermally resistant wadding housed within a volume encompassed between the first and second sheets of material and a perimeter of the frame.

8. The insulated fire panel shutter as claimed in claim 7, wherein the frame is metal and an exterior face of each of the first and second sheets of material is covered with a metal sheet in a sliding fit arrangement.

9. The insulated fire panel shutter as claimed in claim 7, wherein the wadding comprises a ceramic material and a silica fabric material.

10. The insulated fire panel shutter as claimed in claim 7, wherein when the shutter is closed, the metal components forming each of the panels do not contact each other.

11. The insulated fire panel shutter as claimed in claim 10, wherein the metal components between adjacent panels are kept apart by a separating member, wherein the separating member is a ceramic material.

12. The insulated fire panel shutter as claimed in claim 1, further comprising a flexible flame baffle sheet moveable from a stowed position to a deployed position, the flexible flame baffle sheet being operatively connected to the last panel of the shutter and adapted to span any gap between the top of the fire panel shutter and the top of a doorway to which the insulated fire panel shutter is fitted.

13. A building or structure incorporating an insulated fire panel shutter as claimed in claim 1.

14. The insulated fire panel shutter as claimed in claim 1, wherein each retractable member of the one or more retractable members comprises a plurality of biasing hinges configured to permit movement of the retractable member between the retracted position and the extended position, and wherein each retractable member is connected to a portion of the respective guide by the plurality of biasing hinges.

15. The insulated fire panel shutter as claimed in claim 14, wherein the plurality of biasing hinges are configured to bias each retractable member of the one or more retractable members towards the extended position.

16. The insulated fire panel shutter as claimed in claim 1, wherein each retractable member of the one or more retractable members comprises a top end and a bottom end, wherein the bottom end of each retractable member terminates with the camber.

17. The insulated fire panel shutter as claimed in claim 16, wherein at least one panel of the plurality of panels comprises at least one biasing member attached to a base portion of the at least one panel and configured to bias the retractable member of the one or more retractable members into the retracted position as the shutter moves from the open position to the closed position.

18. The insulated fire panel shutter as claimed in claim 17, wherein the at least one biasing member comprises a pair of opposed biasing members, wherein a first biasing member of the pair of opposed biasing members is disposed on the front face of the panel and a second biasing member of the pair of opposed biasing members is disposed on the rear face of the panel.

19. The insulated fire panel shutter as claimed in claim 18, wherein when the at least one biasing member abuts the respective camber, the respective retractable member of the one or more retractable members is configured to move from its retracted position to its extended position, thereby permitting the guide to engage the front and rear faces of each panel.

* * * * *